US006234468B1

(12) United States Patent
Janatka et al.

(10) Patent No.: US 6,234,468 B1
(45) Date of Patent: May 22, 2001

(54) DUAL POCKET RIGHT ANGLE TURN FOR AN ENVELOPE TRANSPORT SYSTEM

(75) Inventors: Karel J. Janatka, Southbury, CT (US); John W. Sussmeier, Cold Spring, NY (US); William J. Wright, Killingworth, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/464,245

(22) Filed: Dec. 16, 1999

(51) Int. Cl.[7] ..... B65H 5/00

(52) U.S. Cl. ..... 271/2; 271/9.13; 271/225; 271/303; 271/184

(58) Field of Search ..... 271/2, 9.01, 9.13, 271/10.01, 225, 303, 184

(56) References Cited

U.S. PATENT DOCUMENTS 6,036,185 * 3/2000 Baumann et al. ..... 271/2
6,062,556 * 5/2000 McCay ..... 271/9.13
6,107,579 * 8/2000 Kinnemann ..... 271/2 X

* cited by examiner

*Primary Examiner*—David H. Bollinger
(74) *Attorney, Agent, or Firm*—Michael J. Cummings; C. J. Capelli; Michael E. Melton

(57) ABSTRACT

An envelope transport system, for transporting envelopes, flaps opened, along a final common path in a direction at ninety degrees from a feed direction along which the envelopes are provided in two parallel paths. The system includes an envelope hopper, for holding envelopes on edge and for providing the envelopes, in turn, on edge; a flipper gate, for receiving envelopes, in turn, and for providing the envelopes alternately to either of the two parallel transport feed paths, each of the feed paths for conveying the envelopes provided to the feed path by action of a sequence of nips arranged along the feed path; a merge station for receiving the envelopes, in turn, from the two parallel transport feed paths, for plowing open the flaps of the envelopes, and for redirecting the envelopes, with flaps open, all to the final, common path at substantially ninety degrees from the two parallel transport feed paths, the substantially ninety degrees measured with respect to the direction of the parallel transport feed paths at the point of entry to the merge station.

4 Claims, 4 Drawing Sheets

DUAL POCKET RIGHT ANGLE TURN FOR AN ENVELOPE TRANSPORT SYSTEM

TECHNICAL FIELD

The present invention pertains to a mailing system for creating mail pieces, including an envelope and mail pages, and more particularly to an envelope transport system as part of such a mailing system.

BACKGROUND OF THE INVENTION

In designing a mailing system used to create mail pieces, each mailing piece consisting of mail pages inserted in an envelope, throughput with reliability is always an objective. To achieve reliability it is sometimes advantageous to provide parallel paths, each path operating at a lower throughput than the desired overall throughput so that mail piece components do not change velocity so quickly as to be damaged or to jam in the mailing system.

Many mailing systems include insertion engines, which insert mail pages into an envelope (after the mail pages are folded, if necessary). In some mailing systems with an insertion engine, throughputs as high as 18,000 mail pieces per hour (five per second) are achieved. In such a mailing system, an insertion engine is provided with the envelopes of the mail pieces by an envelope transport system (and is provided with the pages of the mail pieces, to be inserted into the envelopes, by a page transport system).

The envelope transport system includes an envelope hopper (12 of FIG. 1) that must be periodically loaded with envelopes. In some mailing systems, because of various constraints, it is necessary that the envelope hopper be on the same side of the mailing system as where the operator is stationed, and of course that the envelope hopper be easily loadable. An envelope hopper typically holds about 1500 envelopes when fully loaded, and so must be replenished about every five minutes when used in a mailing system operating at a throughput of five mail pieces per second.

In some mailing system architectures, all of these requirements combine so that a layout of the envelope transport system can use a planar envelope hopper (12 of FIG. 1) feeding envelopes (11 of FIG. 1) on edge. In such a situation, what is needed is a design for an envelope transport system that allows using such a feeder, and that provides envelopes at the required high throughput, but that keeps changes in the envelope velocity to within acceptable limits.

SUMMARY OF THE INVENTION

Accordingly, the present invention provides an envelope transport system including: an envelope hopper, for holding envelopes on edge and for providing the envelopes, in turn, on edge; a flipper gate, for receiving envelopes, in turn, and for providing the envelopes alternately to either of two parallel transport paths; the two parallel transport paths, each of the paths for conveying the envelopes provided to the path by action of a sequence of nips arranged along the path; a merge station for receiving the envelopes, in turn, from the two parallel transport paths, for plowing open the flaps of the envelopes, and for redirecting the envelopes, with flaps open, all to a final, common path at substantially ninety degrees from the two parallel transport paths, the substantially ninety degrees measured with respect to the direction of the parallel transport paths at the point of entry to the merge station.

In another aspect of the invention, the merge station includes for each parallel transport path a D-shaped roller for hoisting the envelopes from the parallel transport path onto the final, common path.

In a still further aspect of the invention, the merge station also includes for each parallel transport path a plow flap device for plowing open the flaps of the envelopes being transported along the parallel transport path as the envelopes enter the merge station.

In yet a still further aspect of the invention, the merge station also includes for each parallel transport path an adjustable stop for stopping the envelopes at a point on the parallel transport path so that when the envelopes are hoisted onto the final, common path, a centerline of the envelopes is aligned with the centerline of the final, common path.

BRIEF DESCRIPTION OF THE DRAWINGS

The above and other objects, features and advantages of the invention will become apparent from a consideration of the subsequent detailed description presented in connection with accompanying drawings, in which.

DETAILED DESCRIPTION

Figure 1:
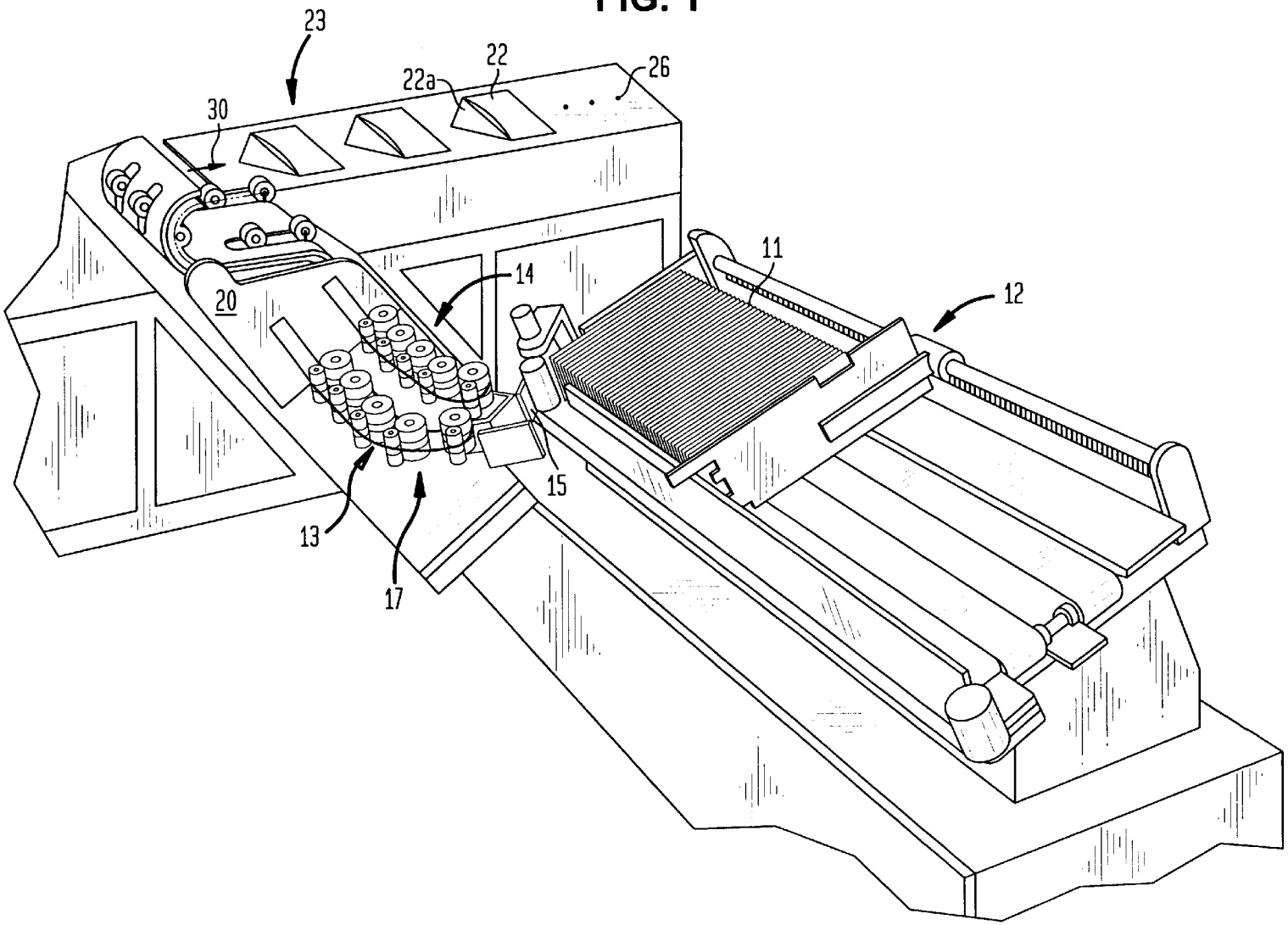
FIG. 1 is a perspective drawing of an envelope transport system according to the present invention.
Figure 2:
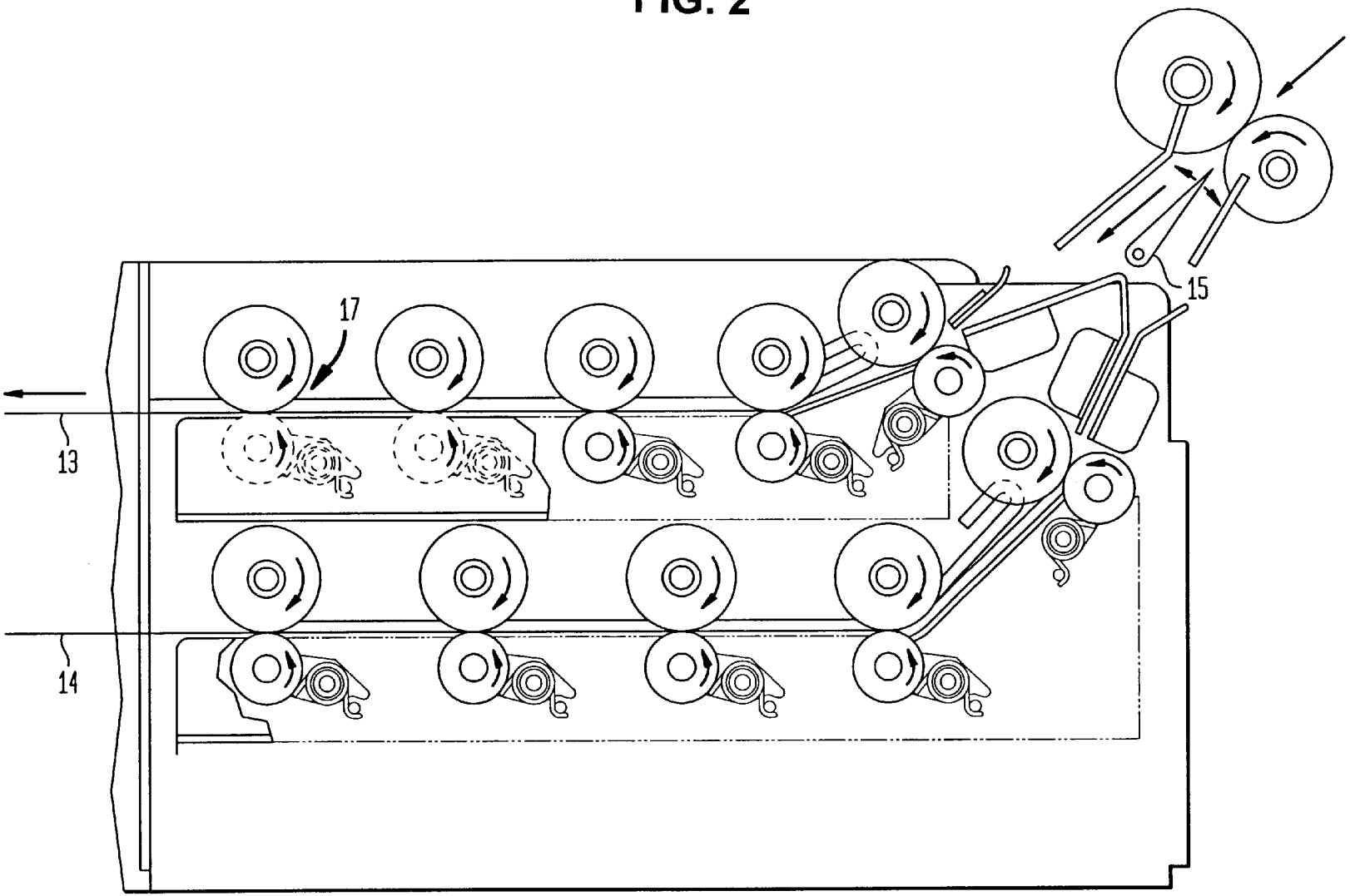
FIG. 2 is a detailed perspective drawing of part an envelope transport system according to the present invention, showing part of two parallel transport paths.

Referring now to FIGS. 1–4, an envelope transport system according to the present invention includes an envelope hopper 12, typically having a capacity of approximately 1500 envelopes, for feeding the envelopes 11 on edge to either one or another of two parallel transport paths 13 14, each envelope 11 directed to one or another of the paths by a flipper gate 15. Each envelope is propelled along the path to which it is directed by a series of nips 17, i.e. by the action of two turning, high-friction wheels disposed so as to be in mutual contact. Each pair of wheels forming a nip grabs (nips) an envelope and pulls it through the point of contact of the wheels at a linear velocity substantially equal to the angular velocity of either wheel, multiplied by its radius.

Both parallel transport paths 13 14 continue into a merge station 20, where an envelope in either path 13 14 is manipulated, as will be described below, so as to open its flap, and is then directed to a final, common path 30 of the envelope transport system, at ninety-degrees to the two parallel paths 13 14, and leading to a conveyor 23. Envelopes 22 on the conveyor 23 lie with their flaps open, as shown, and are conveyed to an insertion engine (not shown).

Figure 3:
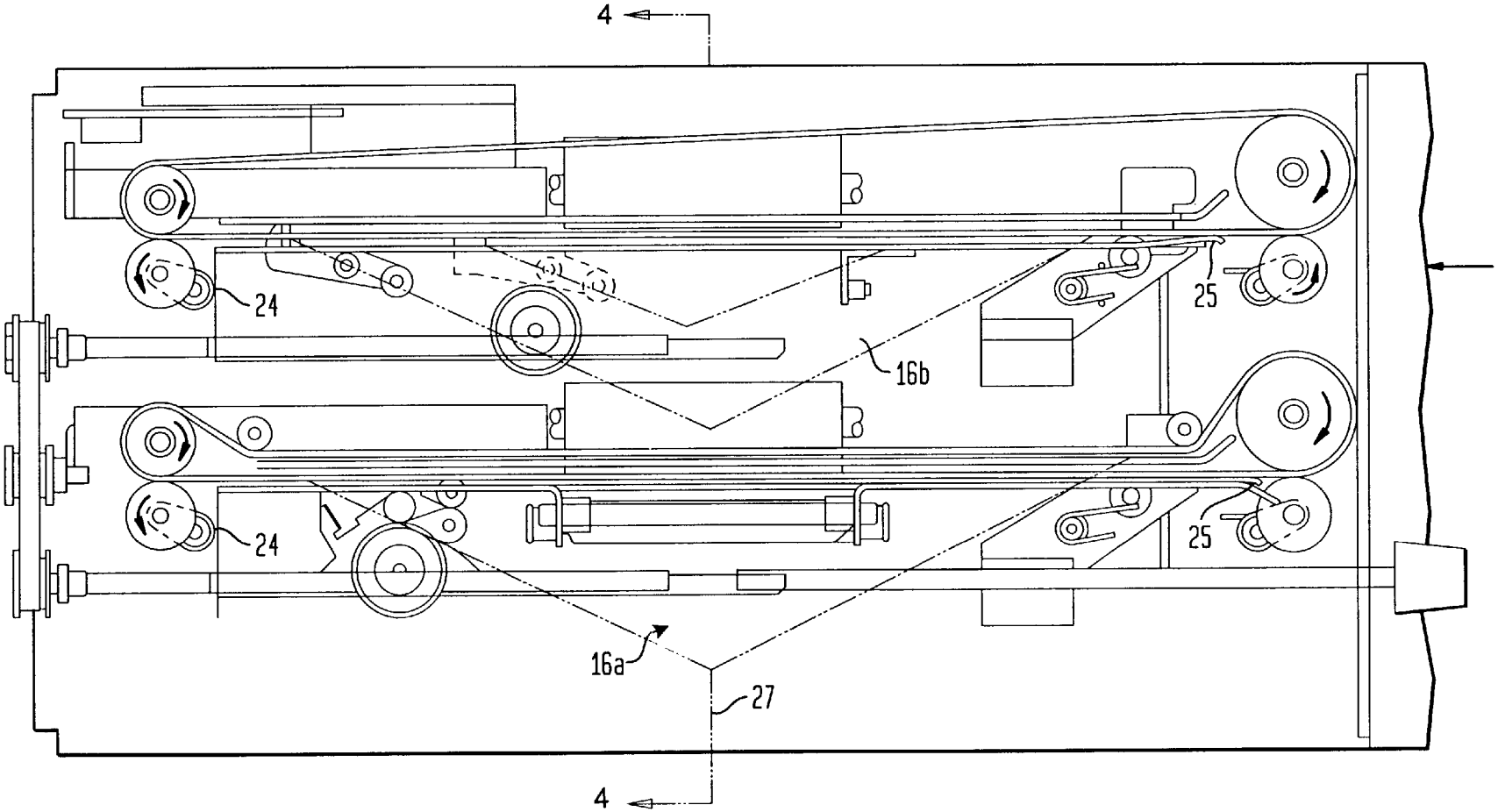
FIG. 3 is a detailed orthographic drawing of part an envelope transport system according to the present invention, showing a view of part of a merge station.
Figure 4:
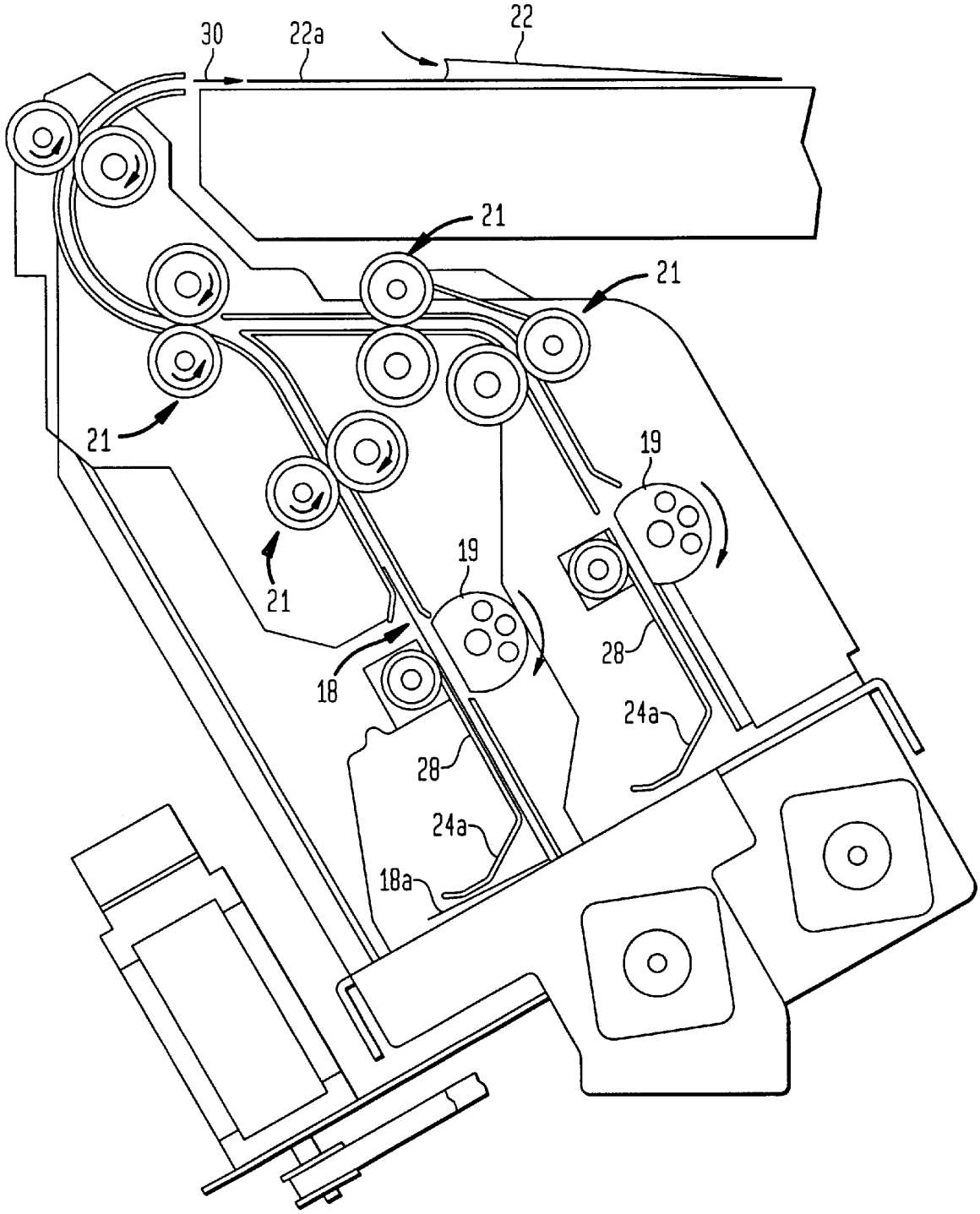
FIG. 4 is a detailed orthographic drawing of a view of the merge station called out in FIG. 3.

Referring now in particular to FIGS. 3 and 4, envelopes 16*a* and 16*b* in turn move into the merge station 20 (FIG. 1) until reaching adjustable stops 24. The stops are accumulator-type stop and catch mechanisms, and are adjusted so that, depending on the size of the envelopes, the centerline 27 of an envelope in the merge station is aligned with the centerline 26 of the conveyor (see FIG. 1). As an envelope 18 is transported into the merge station 20, a conventional plow flap device 25 is used to plow open ninety degrees the flap 18*a* of the envelope. Plowing open the flap of an envelope only ninety degrees allows the envelope to be crease-line justified.

Once inside the merge station, in response to a signal from an arming station (not shown) of the inserter, the envelope is hoisted out of its parallel path 13 14 onto a final, common path 30, at ninety degrees to the parallel transport paths 13 14, by the action of a D-shaped roller 19, there being provided one such roller for each parallel transport path 13 14, and a combination of merge nips 21. During the hoisting motion, the flap of the envelope is opened the remaining 90 degrees, to full open, by arms 24*a* extending out from guides 28 for the parallel transport paths inside the merge station 20. The end result is that an envelope 22 is laid on the conveyor 23 with its flap 22*a* down and full open, and moving along the final, common path 30 on the conveyor 23 toward an inserter engine (not shown).

Of course it is possible that in some applications the parallel transport paths 13 14 do not continue always in a straight line to the merge station 20. Therefore, the redirection performed at the merge station 20, which is substantially ninety degrees, is to be understood as measured with respect to the direction of the parallel transport paths 13 14 at the point where they enter the merge station 20.

It is to be understood that the above-described arrangements are only illustrative of the application of the principles of the present invention. Numerous modifications and alternative arrangements may be devised by those skilled in the art without departing from the spirit and scope of the present invention, and the appended claims are intended to cover such modifications and arrangements.

What is claimed is:

1. An envelope transport system, comprising:

a) an envelope hopper, for holding and feeding envelopes on edge;

b) a flipper gate, for receiving envelopes, in turn, and for providing the envelopes alternately to either of two parallel transport paths;

c) the two parallel transport paths, each of the paths for conveying the envelopes provided to the path by action of a sequence of nips arranged along the path; and d) a merge station for receiving the envelopes, in turn, from the two parallel transport paths, for plowing open the flaps of the envelopes, and for redirecting the envelopes, with flaps open, all to a final, common path at substantially ninety degrees from the two parallel transport paths, the substantially ninety degrees measured with respect to the direction of the parallel transport paths at the point of entry to the merge station.

2. The envelope transport system of claim 1, wherein the merge station includes for each parallel transport path a D-shaped roller for redirecting the envelopes to the common path by hoisting the envelopes from the parallel transport path onto the final, common path.

3. The envelope transport system of claim 2, wherein the merge station includes for each parallel transport path a plow flap device for plowing open the flaps of the envelopes being transported along the parallel transport path as the envelopes enter the merge station.

4. The envelope transport system of claim 3, wherein the merge station includes for each parallel transport path an adjustable stop for stopping the envelopes at a point on the parallel transport path so that when the envelopes are hoisted onto the final, common path, a centerline of the envelopes is aligned with the centerline of the final, common path.

* * * * *